United States Patent [19]
Elhaus et al.
[11] 4,404,043
[45] Sep. 13, 1983

[54] METHOD OF AND AN APPARATUS FOR CONTINUOUS HEAT TREATMENT OF SEPARATED ELONGATED METALLIC MATERIAL

[75] Inventors: Friedrich W. Elhaus, Jägerhofstr. 117 a, D-5600 Wuppertal 1; Manfred Wäschle, Singen, both of Fed. Rep. of Germany

[73] Assignee: Friedrich W. Elhaus, Wuppertal, Fed. Rep. of Germany

[21] Appl. No.: 218,612

[22] Filed: Dec. 22, 1980

Related U.S. Application Data

[63] Continuation of Ser. No. 34,356, Apr. 30, 1979, abandoned.

[30] Foreign Application Priority Data

Mar. 1, 1979 [DE] Fed. Rep. of Germany ..... 2907960

[51] Int. Cl.[3] ..... C22F 1/04

[52] U.S. Cl. ..... 148/13; 148/20.3; 148/157; 266/87; 266/88; 266/251; 266/252

[58] Field of Search ..... 148/13, 20.3, 157; 266/87, 88, 251, 252

[56] References Cited

U.S. PATENT DOCUMENTS 3,953,247 4/1976 Elhaus et al. ..... 148/13
4,135,704 1/1979 Elhaus et al. ..... 266/261

OTHER PUBLICATIONS

Modern Metals, p. 9, Sep., 1972.

*Primary Examiner*—R. Dean
*Attorney, Agent, or Firm*—Hume, Clement, Brinks, William & Olds, Ltd.

[57] ABSTRACT

In a method for continuous heat treatment of separated elongated metallic material said material is conveyed stepwise through a single furnace chamber. Said furnace chamber comprises a heating section and an adjacent holding section. In the heating section the material is heated up to a treating temperature and in the holding section the material is held at the treating temperature both in an atmosphere of forced circulation of hot gas common to both furnace sections. The temperature of the circulated hot gas is automatically feedback-controlled at the location of the transition between the heating section and the holding section, the hot gas being set into forced motion in a single circulating zone and being heated up in a single heating zone with respect to the direction of passage of the material. Additionally the temperature of the material may be measured at the said location of the transition between the heating section and the holding section and the conveying movement of the material may be interrupted for the time necessary to heat up the material to the treating or holding temperature.

21 Claims, 3 Drawing Figures

METHOD OF AND AN APPARATUS FOR CONTINUOUS HEAT TREATMENT OF SEPARATED ELONGATED METALLIC MATERIAL

This is a continuation of application Ser. No. 034,356, filed Apr. 30, 1979, abandoned.

The invention relates to a method of and an apparatus for continuous heat treatment of separated individual elongated metallic material, such as round bars or billets, tubes or the like, especially of aluminum or magnesium and their alloys, in which the material is preheated to the required temperature in a preheating section during the continuous transport and is subsequently held warm at this temperature in a holding section.

Methods and apparatus of this kind are already known (see the journal "Modern Metals", Sept. 1972, page 9, a company publication by the Sunbeam Equipment Corporation). Here the material is preheated in a preheating atmosphere of its own in the preheating section having its own heating and circulating apparatus and is kept warm in a holding atmosphere of its own in the holding section having its own heating and circulating apparatus. With the known method and apparatus the circulating zones influence each other and the desired quality requirements cannot be met, above all not with respect to uniformity because with the known procedure temperature variations cannot be avoided which lead to different grades of the finished material. Besides, the separate heating and circulating of the hot gas (hot air) in the two sections is expensive.

Starting from the known method described above, it was suggested to separate the heating and the keeping warm altogether (DE-AS No. 22 56 978) in order to improve the uniformity of the quality and, at the same time, obtain greater variability of the course of temperature versus time. According to that reference the material is heated quickly in a preheating furnace and is kept warm while being rotated about its longitudinal axis in a separate holding furnace provided with a separate transport device. Although this did improve the quality and provide greater flexibility, it requires great expenditure since separate furnaces with separate transport devices must be provided.

It is the object of the invention to provide a method and an apparatus of the kind defined initially which are simpler in mode of operation and structure and yet produce a final product of better quality, comparable with the quality obtained by the method mentioned last.

To meet this object, it is provided with the method of the kind specified initially that, in accordance with the invention, the material is heated and kept hot by hot gas in forced circulation and at controlled temperature in an atmosphere which the preheating and the holding sections have in common, the hot gas being preheated in a single heating zone and being set into forced motion in a single circulating zone, with respect to the direction of passage of the material.

Important in this respect is the control of the hot gas temperature, above all at that place of the transit distance to which the theoretical or rated temperature is referred and at which the actual temperature of the hot gas is measured. In accordance with an advantageous further development of the method according to the invention this is the location of the transition between the preheating section and the holding section.

Control of the hot gas temperature alone provides a final product of high grade. Yet to obtain even further improvement regarding the uniformity of the product, the temperature of the material is measured as well, preferably at the transition between the preheating and the holding sections. And the transport of the material is interrupted until the material has reached the desired treatment temperature. This is a measure which insures that under any circumstance, i.e. even if the hot gas temperature control is not absolutely correct, the only material reaching the holding section will be material which has attained the desired treatment temperature. In this manner an exact maintaining of the given holding time is rendered possible. The holding time is determined by the product of material places available multiplied by the cycle period.

With elongated material it is convenient to have a plurality of heating and holding zones, and control zones combining the same in pairs, in side by side relationship, traversely of the direction of passage and in longitudinal direction of the material.

Furthermore, it is advantageous to heat and hold the material hot in countercurrent, i.e. by hot gas flowing in opposed direction to the conveying direction, preferably such that the longitudinal extension of the material is oriented transversely of the conveying direction and of the direction of flow of the hot gas.

It further serves to promote the uniformity of the quality if the material is rotated about its longitudinal axis in per se known manner during the preheating and holding and possibly also during a subsequent cooling process, as already known in connection with the holding and cooling (DE-OS No. 23 49 765).

A special method in accordance with the invention provides for the material to be sheared off after the holding process and to be cooled to a temperature for further treatment, in particular a temperature for pressing, such as useful, for instance, for producing extruded sections of light metal.

An apparatus for carrying out the method of the invention, using a furnace with a single chamber and a single continuous transport device, as already known, ("Modern Metals", Sept. 1972, page 9, company publication by the Sunbeam Equipment Corporation) is characterized, in accordance with the invention, in that, based on the direction of passage, there are provided a single heating device, a single circulating device for preheating the material and keeping it hot, and a single temperature control device to control the hot gas temperature.

An essential advantage of this apparatus is its simple structure which includes but a single heating device and a single circulating device, based on the direction of passage, whereas the known apparatus comprises two such means each, which influence each other.

Transversely of the direction of passage, the furnace may comprise a plurality of zones each of which comprises a heating device and a circulating device and a temperature control device for the hot gas in order to further improve the uniformity of the quality throughout the length, especially in the heat treatment of elongated material.

The transport device used in the unitary furnace preferably is a lifting beam transport device extending through the furnace and conveying the material stepwise while rotating it, as is known per se (DE-OS No. 27 12 279).

Preferably, the actual temperature of the hot gas at the transition between the preheating section and the holding section is measured by a temperature sensor provided in the or each control zone. The temperature sensor signals are applied to the or each temperature control device which in turn acts on the heater through an adjusting device.

In accordance with a further modification of the apparatus according to the invention a temperature sensor for the temperature of the material is provided for the or each control zone to measure the temperature of the material at the transition between the preheating section and the holding section in order to guarantee that, no matter what the circumstances, only material at the desired rated temperature can enter the holding section. The temperature sensor signals are applied to a control device which stops the drive of the transport device, through a switching device, as long as the material ahead of the transition has not reached the desired material temperature. The apparatus according to the invention may be supplemented by a hot shearing means and a cooling device to cool the sheared material to a temperature suitable for further processing.

The invention will be described in more detail below, with reference to the accompanying diagrammatic drawings, in which.

Figure 1:
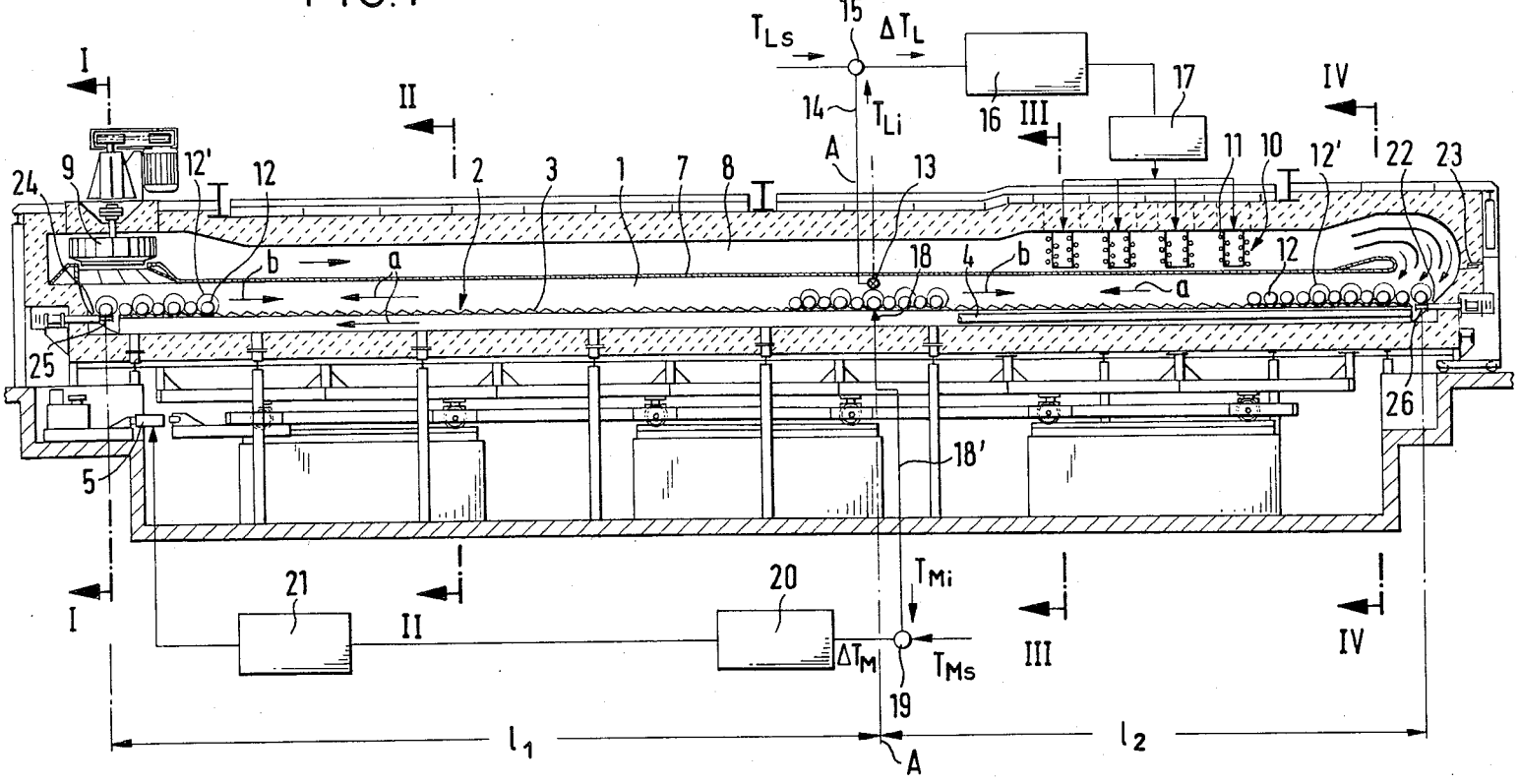
FIG. 1 is a longitudinal sectional elevation of an apparatus according to the invention.
Figure 2:
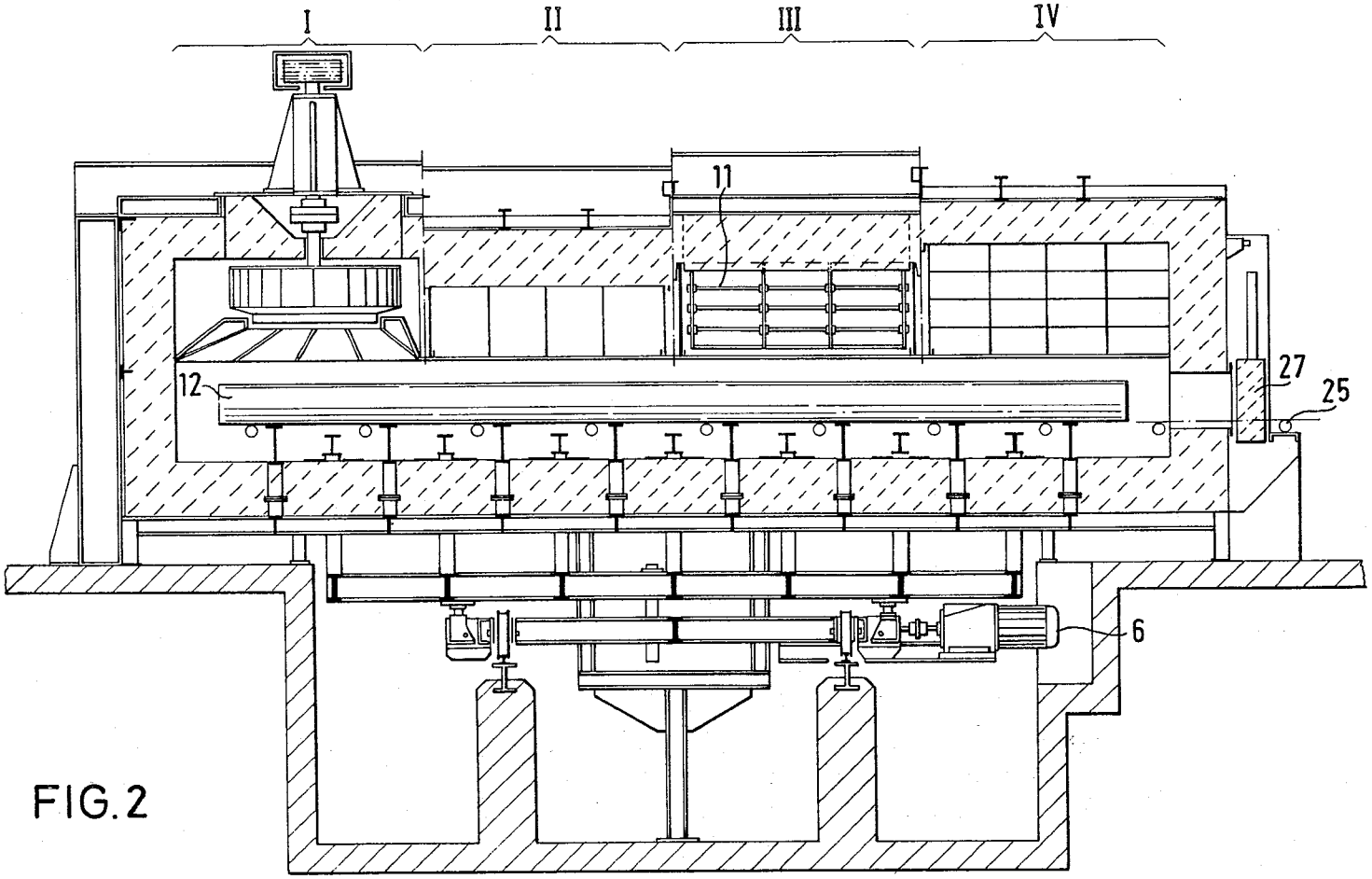
FIG. 2 is a cross sectional elevation of the furnace shown in FIG. 1, on an enlarged scale, composed of four part sections on lines I—I, II—II, III—III, and IV—IV in FIG. 1.

The apparatus shown in FIGS. 1 and 2 comprises a uniform furnace with a single chamber 1 and a single continuous transport device 2 having fixed beams with saw-tooth like elevations 3 and lifting beams 4. An hydraulic drive means 5 displaces the lifting beams 4 in horizontal direction and, independently thereof, they are movable in vertical direction by an electric drive means 6 (FIG. 2).

The chamber 1 is divided into four successive zones I, II, III, and IV. Each of these zones includes a preheating section having a length $l_1$ and a holding section having a length $l_2$ (FIG. 1). Above a partition 7 which closes the actual chamber 1 at the top, there is provided in each zone a channel 8 in which the air constituting the furnace atmosphere is circulated and heated. Circulation of the air is caused by a fan 9 shown at the left in FIG. 1. The heating in turn is effected by an arrangement of a total of four groups 10 of electrically heated rods 11 extending transversely through the channel 8 (FIG. 2). At the right end of channel 8, as seen in FIG. 1, the air thus heated and circulated is deflected so as to flow in the direction of arrow a in countercurrent to the conveying direction b of the transport device 2, passing over and under the material 12 being treated which is shown in the figures to be composed of round bars or billets. For purposes of illustration the billets 12, 12' are shown in FIG. 1 to have different diameters in order to demonstrate that elongated material having cross sectional dimensions which vary by more than 100% can be transported through the furnace. At the transition, marked by the axis A—A in FIG. 1, between the preheating section and the holding section a thermoelement 13 is disposed in the chamber 1 to measure the hot air temperature. The actual temperature $T_{Li}$ measured is applied through a line 14 to a comparator location 15 at which the actual hot air temperature $T_{Li}$ is compared with the adjustable rated hot air temperature $T_{Ls}$. The resulting difference $\Delta T_L$ is applied to a controller 16 which emits an adjustment signal through an adjustment device 17 to adjust the heater such that the hot air temperature will be reduced with a view to reducing the difference $\Delta T_L$.

Furthermore, a contact thermoelement 18 is arranged at the level of axis A—A. It is designed as a pneumatically operable pointed element adapted to be moved against the surface of the material being treated and to be retracted during the material transport. This thermoelement 18 transmits the metal temperature measured $T_{Mi}$ through a corresponding line 18' to a comparator location 19 which also receives a selected given rated metal temperature $T_{Ms}$. The difference $\Delta T_M$ is applied to a control device 20 which acts through a switching device 21 to stop the drive means 5, 6 until $T_{Mi}=T_{Ms}$ in other words, until the surface of the material has reached the rated temperature $T_{Ms}$. Only then are the drive means 5, 6 and thus the transport device reactivated. This guarantees that only billets having the desired rated temperature will be located in the holding section and that the corresponding holding time to keep each individual billet 12, 12' hot can be observed. This holding time is the product of a selected cycle period of the lifting beam steps multiplied by the number of billets 12, 12' located in the holding section.

In addition to the thermoelements described, further thermoelements may be provided for checking the temperature of the material at the material outlet shown at 22 and at the hot gas inlet shown at 23 (both at the far right end in FIG. 1). The temperatures thus measured are recorded in per se known manner. In similar manner, the material inlet temperature may be measured by a thermoelement, shown at 24 at the material inlet, and then recorded.

Reference numeral 25 designates an entry roll table and 26 an exit roll table for the material which enters and leaves chamber 1 through a pneumatically operated door 27 (FIG. 2).

FIG. 2 above all shows the arrangement of four zones, one beside the other, and each one including a preheating section and a holding section as well as its own circulation means 9, heater 10, and hot gas temperature control devices 13 to 17. In FIG. 2 the zones are designated I, II, III, and IV. The provision of these zones makes it possible to preheat the material 12 and keep it warm very accurately throughout its entire length, as shown in particular in FIG. 2. The control circuit for the material temperature $T_M$, including component elements 18 to 21 which influence the drive means 5, 6 may likewise be provided several times, i.e. once per each zone of control. However, it is also conceivable to provide this control circuit only once for all the control zones.

Figure 3:
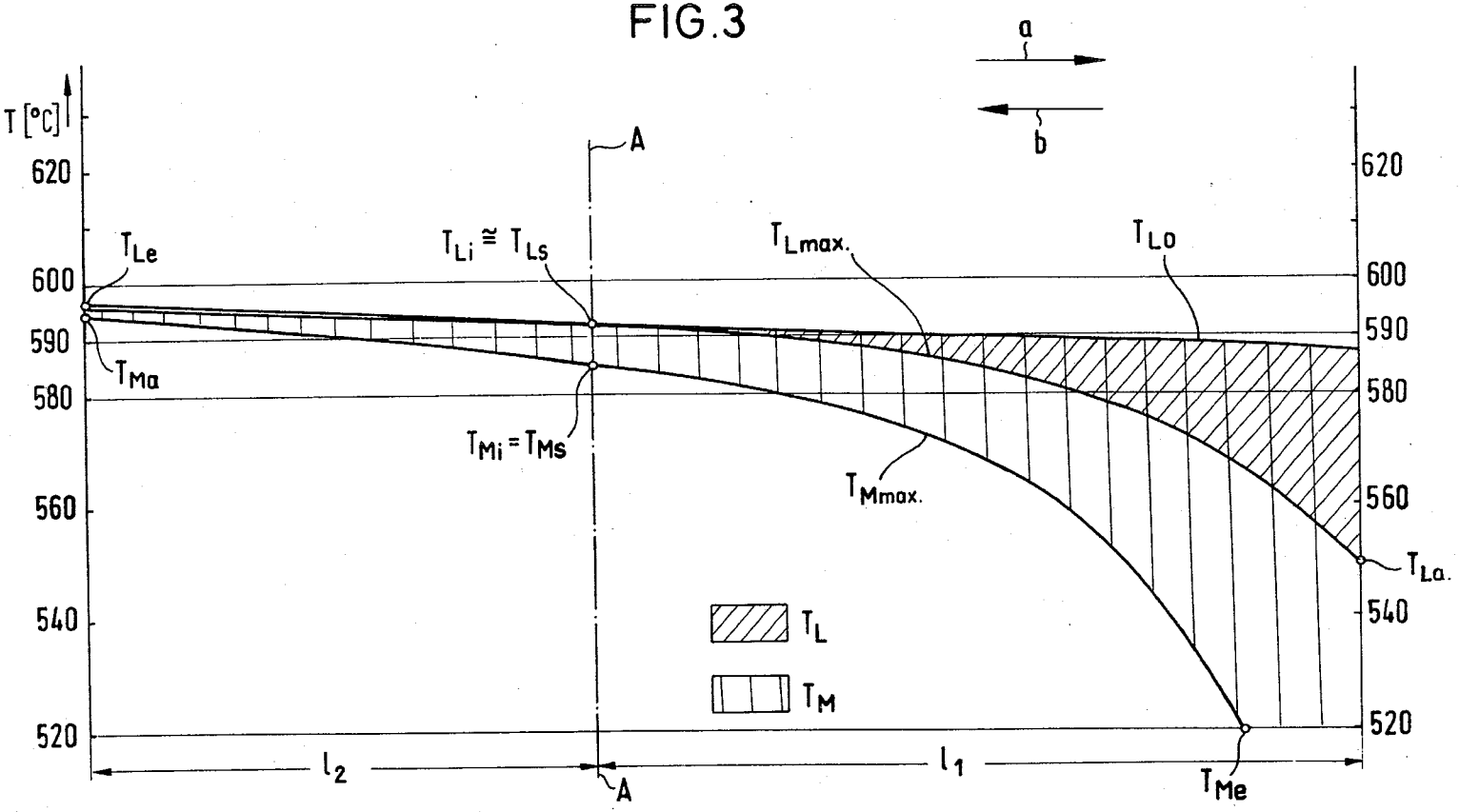
FIG. 3 is a diagram illustrating the temperature conditions which are plotted above the longitudinal dimension of the apparatus according to FIGS. 1 and 2.

The mode of operation of the apparatus described will be explained by referring to the graphical representation according to FIG. 3;

In the diagram of FIG. 3 the temperature characteristics are entered above the furnace length. $T_{LO}$ designates the curve of the hot gas temperature with zero throughput of material. $T_{Lmax}$ designates the curve of the hot gas temperature at maximum throughput of material. $T_{Mmax}$ indicates the curve of the material temperature at maximum throughput. $T_{Le}$ is the hot gas inlet temperature and $T_{Ma}$ is the material outlet temperature. Oblique hatching marks an area of the hot gas temperature, and approximately vertical hatching is to show an area of the material temperature. The transition between the preheating section $1_1$ and the holding section $1_2$ again is marked by the axis A—A. At this place the actual hot gas temperature $T_{Li}$ and the actual material temperature $T_{Mi}$ are measured.

The temperature of the material entering from the right in FIG. 3 takes a course in accordance with curve $T_{Mmax}$ at maximum throughput, i.e. when all the spaces of the transport device 2 are used. The curve $T_{Lmax}$ of the hot gas temperature takes a corresponding course at a higher level. As the material proceeds in the direction of arrow b (material conveying direction), the temperature of the material increases, and this rise is greater than that of the hot gas temperature. If the rated material temperature $T_{Ms}$ is not yet reached at the transition A—A, the transport device 2 is stopped in the manner described until the material temperature has reached the rated value (this is what is shown in FIG. 3). In the embodiment shown, the treatment temperature is selected to be 585° C. In the holding section the temperature of the material changes only slightly, in the order of 10°, until it reaches the outlet temperature $T_{Ma}$. The hot gas, in practice preferably hot air, flowing in the direction of arrow a in FIG. 3 has its maximum temperature $T_{Le}$ at the material outlet at the very left. Starting from the actual temperature measurement of the hot gas at the transition A—A, the heater 10 for the hot gas is governed such that at the transition A—A the hot gas will adopt the rated temperature $T_{Le}$. In the course of the heat transfer to the material which is cool when entering, the temperature of the hot gas decreases progressively to the right. Also the hot gas outlet temperature $T_{La}$ and the material inlet temperature $T_{Me}$ may be measured and recorded for checking purposes.

As a result of the control of the hot gas temperature and of the control of the material temperature described, possibly with blocking of the conveyance at the transition A—A between the preheating and holding sections, the temperature of the material cannot surpass the hot gas temperature at any location of the furnace, at any time, and no matter what the throughput between zero and maximum rates.

Furthermore, the measures described warrant that the required holding time in the holding section, to be determined by means of the product of the cycle period times the material spaces available in the holding section, is always obtained.

Various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What we claim is:

1. In a method of heat treatment of elongated metallic material, such as round bars or billets, in which the material is moved through a preheating section and a holding section, such that the material is preheated to a desired temperature in the preheating section and is subsequently maintained at the desired temperature in the holding section, the improvement comprising:

circulating a volume of gas through a gas heating area adjacent the holding section and through a gas chamber common to both the preheating section and the holding section for circulating the volume of gas, thereby both preheating the material and maintaining the material at the desired temperature with a single flow of circulating heated gas.

2. The method of claim 1 further comprising measuring the gas temperature in a transition area between the preheating section and the holding section and using the measured temperature for controlling the temperature of the gas.

3. The method of claim 1 further comprising measuring the temperature of the material in a transition area between the preheating section and the holding section and interrupting the material movement until the material in the transition area has reached the desired temperature.

4. The method of claims 1, 2, or 3 wherein, transverse to the direction of material movement, a plurality of preheating sections and holding sections are provided in adjacent relationships.

5. The method of claims 1, 2, or 3 wherein, after the gas leaves the gas heating area, the gas is circulated across the material in a direction opposite to the direction of movement of the material.

6. The method of claims 1, 2, or 3 wherein the gas heating area is positioned above the common gas chamber for the preheating section and the holding section and the gas is circulated through the gas heating area in the same direction as the direction of movement of the material, then down into the common gas chamber in which the flow is reversed so that the gas is circulated across the material in a direction opposite to the direction of movement of the material, and then back up toward the gas heating area.

7. The method of claims 1, 2, or 3 wherein the material is conveyed sequentially through the preheating section and the holding section, with the long dimension of the material oriented transverse to the direction of movement of the material and transverse to the direction of gas flow in the preheating section and the holding section.

8. The method of claims 1, 2, or 3 further comprising rotating the material about its longitudinal axis during the gas circulating step that preheats the material and maintains the material at the desired temperature.

9. The method of claims 1, 2, or 3 further comprising shearing off the material after the material has moved through the holding section and then cooling the material.

10. The method of claim 1 further comprising measuring the temperature of the heated gas in a transition area between the preheating section and the holding section, producing an output corresponding to the measured gas temperature, and applying the output to a means for controlling the temperature of the gas.

11. The method of claim 1 further comprising measuring the temperature of the material in a transition area between the preheating section and the holding section, producing an output corresponding to the measured material temperature, and applying the output to a control means for altering the material movement until the output is a desired value.

12. A furnace for heat treatment of elongated metallic material, such as round bars or billets, comprising:

integrated preheating and temperature holding sections having a gas chamber common to the integrated preheating and temperature holding sections for circulating heated gas;

means for moving the material through the preheating and temperature holding sections; and means for circulating heated gas through the common gas chamber such that the material is both preheated and maintained at the desired temperature with a single flow of circulating heated gas.

13. A furnace for heat treatment of elongated metallic material, such as round bars or billets, comprising:

integrated preheating and temperature holding sections having a gas chamber common to the integrated preheating and temperature holding sections for circulating heated gas;

means for moving the material through the preheating and temperature holding sections;

means for heating a volume of gas in a gas heating area adjacent the holding section; and means for circulating the heated gas from the gas heating area and through the common gas chamber such that the material is both preheated and maintained at the desired temperature with a single flow of circulating heated gas.

14. The apparatus of claims 12 or 13 further comprising a plurality of zones transverse to the direction of material movement, wherein each zone includes means for moving the material through the furnace, integrated preheating and heating sections having a common gas chamber, and means for circulating heated gas through the common gas chamber.

15. The apparatus of claims 12 or 13 wherein the material movement means includes a walking beam transport device extending the length of the furnace whereby the material is sequentially transported and simultaneously rotated.

16. The apparatus of claims 12 or 13 further comprising gas temperature sensor means for measuring the temperature of the heated gas in a transition area between the preheating section and the holding section and for producing a corresponding output, means for controlling the temperature of the heated gas, and feedback means for applying the output of the gas temperature sensor means to the gas temperature control means.

17. The apparatus of claims 12 or 13 further comprising material temperature sensor means for measuring the temperature of the material at a transition area between the preheating section and the holding section and for producing a corresponding output, control means for delaying advancement of the material movement means as long as the material in the transition area has not reached a desired temperature, and feedback means for applying the output of the material temperature sensor means to the control means.

18. The apparatus of claim 17 wherein the material temperature sensor means includes a pointed thermoelement supported for movement toward and retraction from the surface of the material.

19. The apparatus of claims 12 or 13 further comprising inlet material temperature sensor means.

20. The apparatus of claims 12 or 13 further comprising outlet material temperature sensor means.

21. The apparatus of claims 12 or 13 further including a hot shearing means for shearing the material after it has been moved through the temperature holding section and means for cooling the sheared material to a temperature suitable for further processing.

* * * * *